United States Patent [19]

Iijima et al.

[11] 4,395,321

[45] Jul. 26, 1983

[54] SEPARATOR ELECTROLYTIC CELL

[75] Inventors: Tokuzo Iijima, Kobe; Yasushi Samejima, Kakogawa; Kazuo Kishimoto, Takasago; Kimihiko Kono, Kobe, all of Japan

[73] Assignee: Kanegafuchi Kagaku Kogyo Kabushiki Kaisha, Osaka, Japan

[21] Appl. No.: 284,517

[22] Filed: Jul. 17, 1981

[30] Foreign Application Priority Data

Jul. 17, 1980 [JP] Japan ..... 55-98453

[51] Int. Cl.[3] ..... C25B 9/00

[52] U.S. Cl. ..... 204/252; 204/282

[58] Field of Search ..... 204/2525–258, 204/263–266, 283, 295–296, 279, 98, 282

[56] References Cited

U.S. PATENT DOCUMENTS

| | | | |
|---|---|---|---|
| 3,923,630 | 12/1975 | Argade et al. | 204/283 X |
| 4,156,639 | 5/1979 | Vallance et al. | 204/252 |
| 4,165,272 | 8/1979 | Cunningham | 204/283 X |
| 4,175,024 | 11/1979 | Darlington | 204/252 |
| 4,236,989 | 12/1980 | Dahlberg | 204/283 X |
| 4,278,523 | 7/1981 | Byrd et al. | 204/283 X |

*Primary Examiner*—Donald R. Valentine

*Attorney, Agent, or Firm*—Armstrong, Nikaido, Marmelstein & Kubovcik

[57] ABSTRACT

A separator electrolytic cell is disclosed which comprises a first electrode compartment surrounded with a releasable wall plate and a glove-shaped finger and a second electrode compartment surrounded with remaining cell walls, a cell top cover and the glove-shaped finger. A sheet-like separator is immediately installed to the cell without any peculiar processing and the cell facilitates assembly and disassembly and provides tight sealing.

11 Claims, 10 Drawing Figures

SEPARATOR ELECTROLYTIC CELL

BACKGROUND OF THE INVENTION

1. Field of the Invention

The present invention relates to a separator electrolytic cell. More particularly, it relates to a finger type electrolytic cell inexpensive in manufacture and suitable for a large capacity which facilitates installation or removal of a separator, especially a cation exchange membrane and further simplifies assemblage or disassemblage of anodes and cathodes.

2. Description of the Prior Art

As a process for production of an alkali metal hydroxide by the electrolysis of an aqueous alkali metal halide solution, above all, an aqueous alkali metal chloride solution, there has been heretofore proposed and practiced commercially electrolytic processes using a separator such as cation-exchange membranes. In these days environmental pollution coming from mercurial processes has come to the fore and accordingly these processes are rapidly being substituted for the mercurial processes. Most of the electrolytic cells used for these processes are filter press type cells in which, for instance, a separator such as ion exchange membrane and microporous membrane is positioned between a cathode compartment frame and an anode compartment frame to give a unit and several or several tens of the units are assembled. The cells of such type are limited in a size of each compartment and a separator has to be positioned to every unit, so that it is difficult to assemble so many units. Moreover, to each compartment a supply inlet for a solution to be electrolysed and a removal outlet for a liquor after electrolysis have to be provided. A great number of supply inlets and removal outlets provided in the anode and the cathode compartments not only require voluminous and complicated operation of connecting many units to each other upon assemblage, but also increase a risk of leakage of liquors produced by the electrolysis from connected portions. Furthermore a risk of leakage from connected portions between the compartment frames also increases inevitably as the number of compartment frames connected increases, which is said to be a fatal disadvantage to the filter press type cells. To prevent this disadvantage a strict mechanical tolerance in design as well as manufacture is needed, thereby inviting an increase in cost of manufacturing. In addition, as the number of compartment frames increases, a greater pressing force must be exerted to thus result in an increased risk of physical damages of the compartment frames and an increased cost.

For the foregoing reasons it is next to impossible to manufacture a filter press type cell of low cost and large capacity.

On the other hand, cation exchange membranes are normally produced in a form of thin sheet with the thickness of several hundred microns and limited dimensions because of making the most use of the performance thereof and of commercial factors in manufacture. That may be a reason why a filter press type cell is widely used as an electrolytic cell bearing a cation exchange membrane.

In order to eliminate the foregoing defects, Japanese Utility Model non-examined publication No. 51,333/1977 discloses an electrolytic cell which comprises anode and cathode compartments having continuously meandering concavo-convex anode and cathode, respectively, and a continuous film-like separator interposed between the anode and the cathode, the anode and cathode compartments are assembled in such a manner that the concave of the cathode or the anode and the convex of the anode or the cathode are interleaved with the separator intervened therebetween.

In the electrolytic cell of this type, however, to avoid physical damages of a separator, a gasket or a spacer must be employed to thereby maintain a clearance given between the cathode and the anode to prevent both electrodes from coming in contact with each other. Because of the clearance, cell voltage increases to thus interfere with the object of enlargement of scale.

In view of the above situation, there is a great need for an electrolytic cell to which a long size thin film-like cation exchange membrane or microporous membrane can be installed as it is and which enables the scale-up of the cell.

In the light of the foregoing problems and the present situation, the present inventors have made an extensive series of study on the development of an electrolytic cell of a large capacity bearing a long size of a separator such as a cation exchange membrane and have already proposed a novel separator electrolytic cell comprised of a plurality of anodes mounted at a bottom plate and a cathode box providing fingers interleaved between adjacent anodes, to the side surfaces of said fingers sheet-like separators being installed by means of separator installation devices located above or below the fingers.

SUMMARY OF THE INVENTION

It is therefore an object of the present invention to provide a separator electrolytic cell in which a flat sheet of separator is immediately applied without any specific processing of the separator.

It is another object of the present invention to provide a separator electrolytic cell which enables assembly or disassembly more feasibly and provides tight sealing to thereby prevent leakage of electrolytes.

It is a further object of the present invention to provide a separator electrolytic cell which permits conversion of existing asbestos diaphragm electrolytic cells to ion exchange membrane electrolytic cells.

These and other objects of the present invention together with the advantages thereof will become apparent to those skilled in the art from the detailed disclosure of the present invention as set forth hereinbelow.

The present invention encompasses a novel separator electrolytic cell characterized in that by a glove-shaped finger comprising two finger-shaped supports extending parallel toward the inside of the cell from the opposite inner peripheries of a frame plate secured to an inner wall of the cell by one releasable wall plate and a separator positioned between the finger-shaped supports, it is separated into a first electrode compartment including the wall plate and a second electrode compartment including remainder walls of the cell, in the first electrode compartment anodes or cathodes are mounted on the wall plate and inserted in fingers and in the second electrode compartment opposite polar electrodes are arranged along the outer side of the fingers.

Figure 1A:
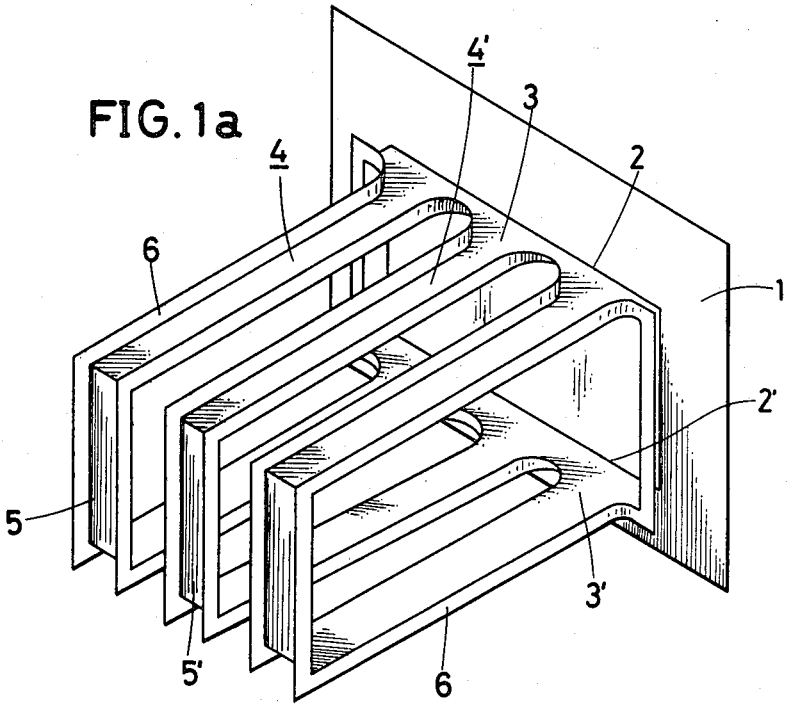
FIG. 1*a* is a perspective view illustrating a typical example of a finger frame which is an essential part of the present electrolytic cell.
Figure 1B:
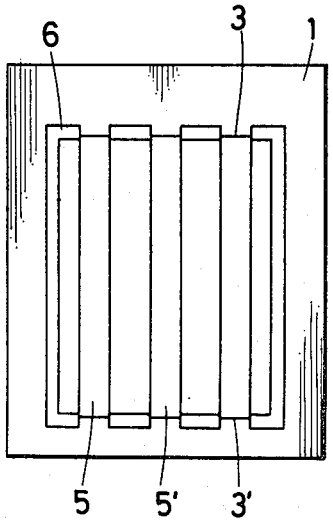
FIG. 1*b*, FIG. 1*c* and FIG.
Figure 1C:
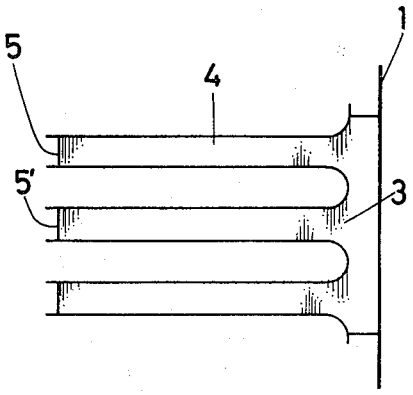
Figure 1D:
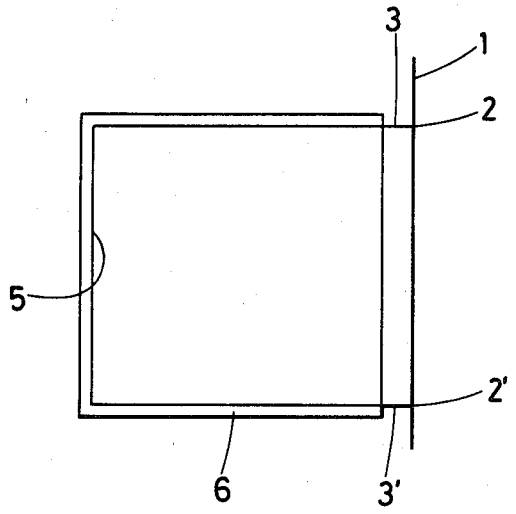

1*d* are a front view, a plan view and a side view, respectively, of the finger frame shown in FIG. 1*a*.

Figure 2:
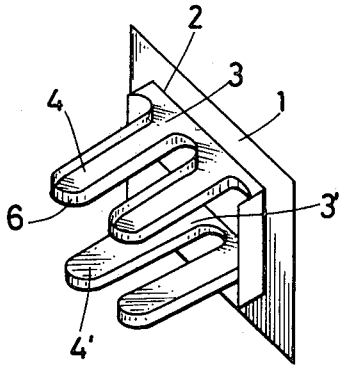
Figure 3:
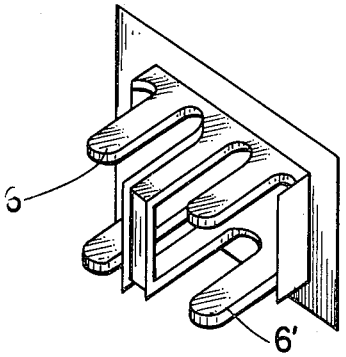

FIG. 2 and FIG. 3 are perspective views, respectively, illustrating other embodiments of the finger frame.

Figure 4A:
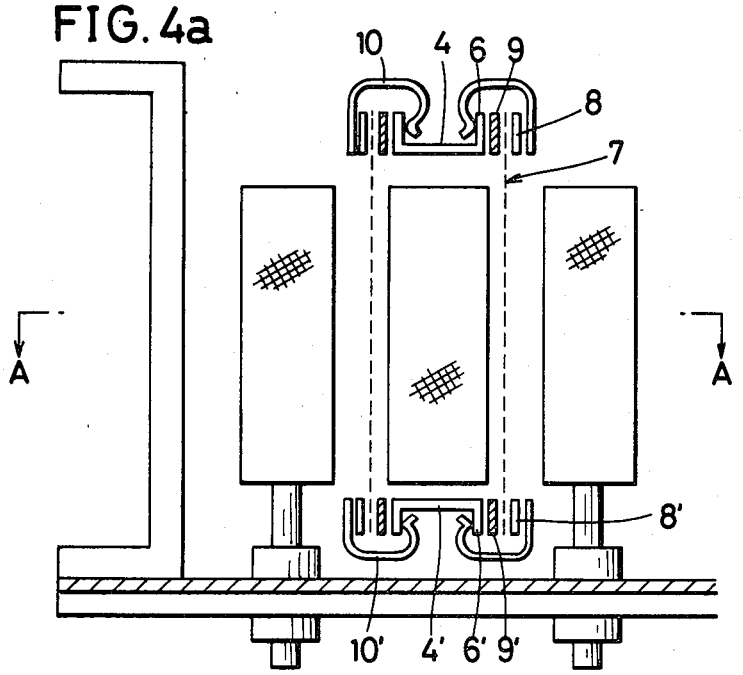
Figure 4B:
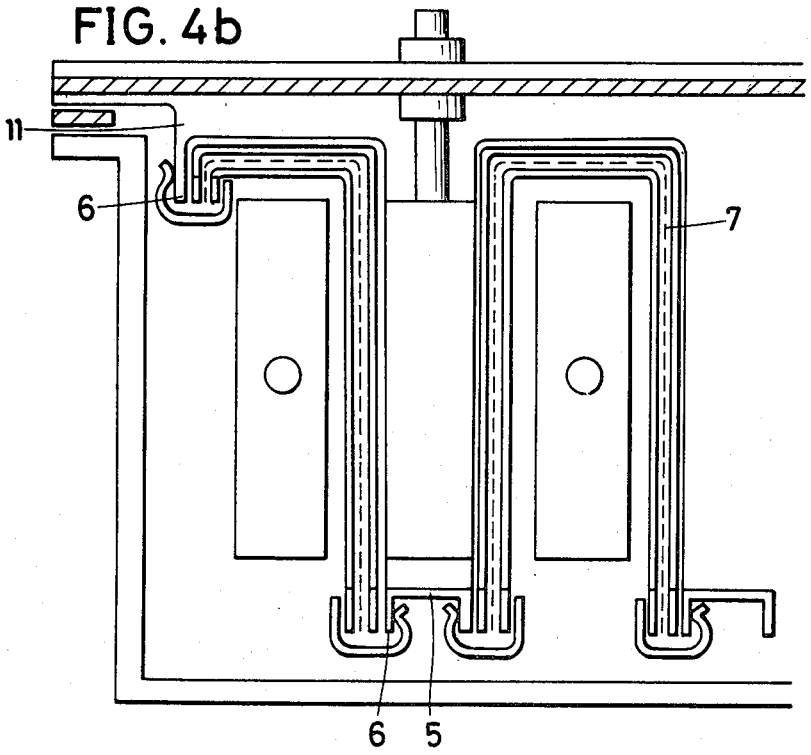

FIG. 4*a* is a vertical sectional diagrammatic illustration illustrating an example in which the separator is secured to the finger frames. FIG. 4*b* is a sectional diagrammatic illustration taken in the direction of arrows along the line A—A of FIG. 4*a*.

Figure 5:
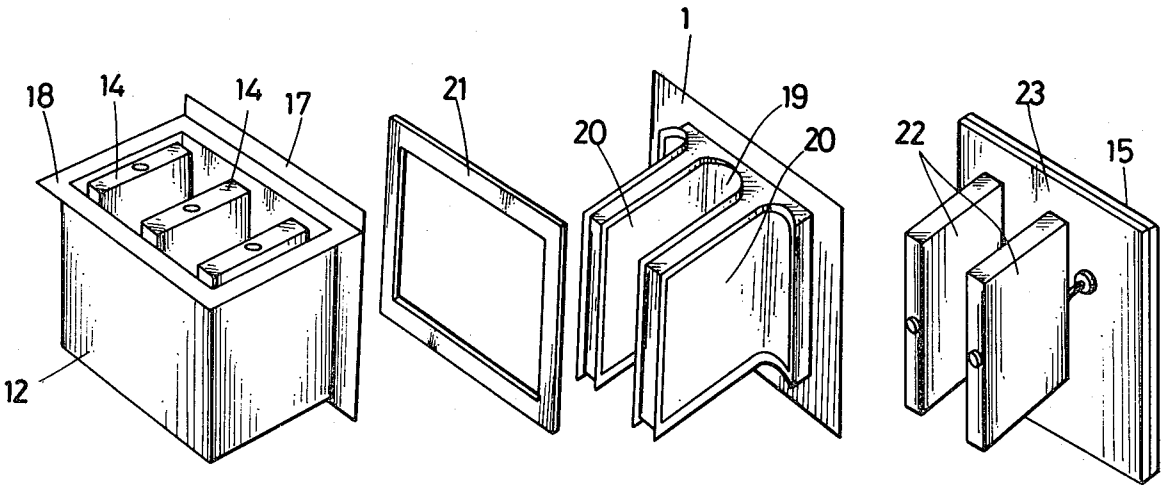
Figure 6:
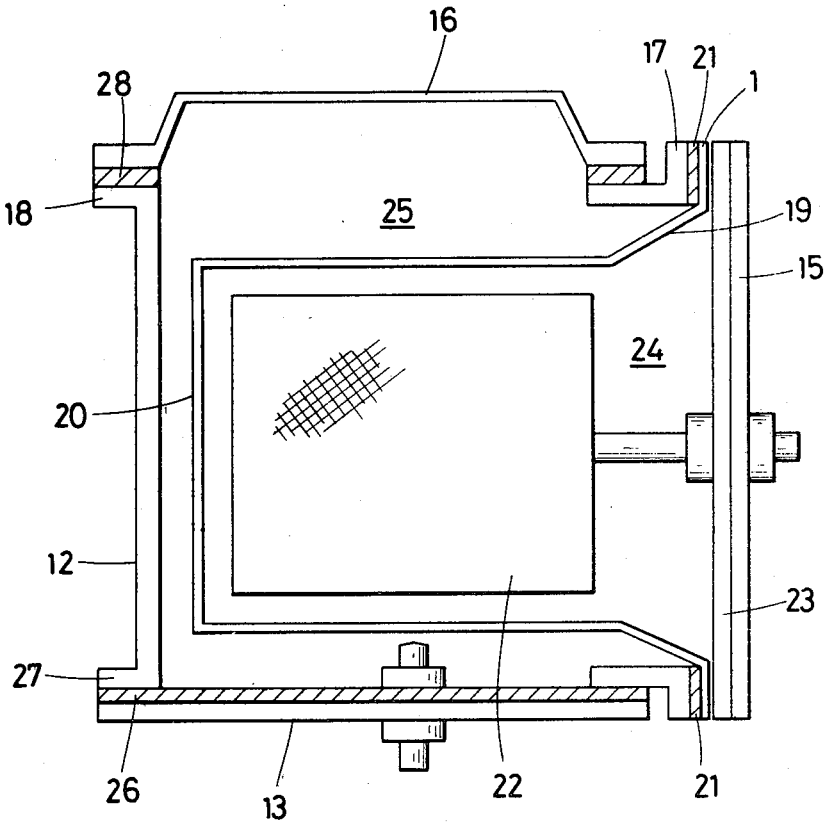

FIG. 5 is a perspective view illustrating disassemblage of the present electrolytic cell, and FIG. 6 is a vertical sectional diagrammatic illustration of the present electrolytic cell assembled.

DETAILED DESCRIPTION OF THE INVENTION

In FIG. 1*a* to FIG. 1*d*, two finger-shaped supports (3), (3') are provided continuously substantially vertical to a frame plate (1) from opposite inner peripheries (2), (2') of four inner peripheries forming a rectangular space in the center of the frame plate (1) and the finger-shaped supports (3), (3') are in the form of the finger having fingers (4), (4') and are substantially parallel to each other with the same shape.

In a typical example of the finger frame shown in said figure, two finger-shaped supports (3), (3') are connected to each other by plates (5), (5') at pointed ends of the fingers. Moreover the finger-shaped supports (3), (3') have collars (6), (6') vertically located to fingers (4), (4') at and along peripheries of the fingers, said collars (6), (6') extending along side peripheries of the plates (5), (5') to form closed loops. Outer collars located at and along outermost fingers also form closed loops at the joints of the fingers.

A finger frame exemplified in FIG. 2 is comprised of two finger-shaped supports (3), (3'), of which fingers (4), (4') are not connected in their points and collars (6), (6') located at and along the peripheries of fingers (4), (4') are connected to the joints of outermost fingers to thereby form, as a whole, closed loops.

FIG. 3 is an eclectic construction of the finger frames shown in FIG. 1 and FIG. 2, which provides two closed loop-shaped collars (6), (6') separated in the central portion.

The finger frame as aforesaid may be made of an anti-corrosive and heat-resistant synthetic resin including polyvinyl chloride, chlorinated polyvinyl chloride, a fluorinated resin such as polytetrafluoroethylene, polyethylenetetrafluoroethylene and polyvinylidene fluoride, a material lined with the foregoing resins or rubbers, an anti-corrosive metal such as titanium, a titanium-paradium alloy and stainless steel, and the like. The finger frame material is preferably an insulated material resistant to both anodic and cathodic solutions. The surface and the reverse side of the finger frame may also be made of different materials resistant to each solution they are in contact with.

The finger frame so constructed bears one or more sheet-like separators (7) located along the closed loop-shaped collars to thus form one or more glove-shaped fingers. In the case of the finger frame illustrated in FIG. 1*a* to FIG. 1*d*, two sheets of short size separator located at the outer sides of the fingers and two sheets of long size separator located between adjacent fingers, i.e., four sheets of separator in total are required. In the case of the finger frame shown in FIG. 2, a sheet of long size separator suffices and in FIG. 3 two sheets of separator are employed.

As the sheet-like separator, a cation exchange membrane or a microporous membrane may be suitably used and to the present electrolytic cell is a cation exchange membrane the most preferable.

Such a separator may be one obtained by cutting a sheet of long size sheet at a suitable length or may be fabricated by joining together a plurality of sheets by, for example, bonding or heat pressing to prepare one having desired dimensions. Moreover such a separator may also be used which comprises bonding a porous anode to the one side of a cation exchange membrane and a porous cathode to the other side. In this case a current collector which is capable of pressing against the electrodes bonded to the separator is employed in place of anodes and cathodes as aforesaid.

The cation exchange membrane suitably used in the present electrolytic cell may preferably be made of a polymer having a fluorine-containing backbone with pendant cation exchange groups such as sulfonic acid groups, carboxylic acid groups and phosphoric acid groups, singly or in combination of two or more. The sheet-like separator may be secured to the collars (6), (6') located on the finger frame by bonding or welding its end brim to the collars.

Hereinbelow will be the explanation with reference to FIG. 4*a* and FIG. 4*b* in which the sheet-like separator (7) is secured to the collars (6), (6') by the use of a mechanical means.

FIG. 4*a* is a diagrammatic vertical sectional view at a right angle to a protruding direction of fingers. Between the collar (6) and a pressing plate (8) the end brim of the separator (7) is interposed and further between the separator (7) and the collar (6) a packing (9) is interposed, whereby the whole is tightened firmly by the use of clips (10) of an anti-corrosive material such as titanium.

FIG. 4*b*, a sectional view taken in the direction of arrows substantially along the line A—A of FIG. 4*a*, depicts that a side brim of the separator is secured similarly to the collar (6) on the side end (11) of the finger frame and the collar (6) on a plate (5). Separator installation processes as above-mentioned only illustrate typical embodiments and accordingly there may be suitably applied a variety of securing means and instruments including bolts and nuts, clips, spring clips, clamps, springs, singly or in combination of two or more, which are suggested in Japanese Utility Model Application Nos. 178,714/1977, 107,197/1978, 57,341/1979 and 91,756/1979.

As a material for the securing means, titanium is preferred for use in the anode compartment and SS, SUS, etc. are preferred for use in the cathode compartment, but it is not particularly limited unless corrosive to anodic and cathodic solutions.

The packing (9) may be preferably in the form of a string, a flat sheet or a protrusion-provided sheet made of a foamed article of polytetrafluoroethylene, a rubber or the like.

The pressing plate (8) may preferably be made of titanium, SS, SUS, a synthetic resin, a glassfiber reinforced resin or the like.

A separator installation apparatus by the use of a mechanical securing means as mentioned in detail earlier ensures and facilitates the installation of a separator to and along the winding face of the finger frame, so that changing of the separator damaged or blocked is possible very feasibly, thereby being by far superior as compared with bonding, welding or the like.

The installation of the separator by the mechanical securing means is in fact of exceeding importance even for the following reasons, especially when a cation exchange membrane is used as a separator. That is, it is required to position the separator as tight as possible between the cathodes and the anodes. The cation exchange membrane normally expands and contracts according to moisture contained in the circumstances, while a microporous membrane exhibits almost no such a phenomenon. Accordingly the cation exchange membrane, even when installed as tightly as possible in the air, is apt to expand to thereby produce slack and wrinkles during the operation since it comes into contact with an aqueous alkali metal halide solution and an aqueous alkali metal hydroxide liquor. Slack and wrinkles necessarily cause residence of halogen gas at the anode side of the membrane, thus resulting in low quality of the product. Inversely, at the cathode side of the membrane, release of hydrogen gas is prevented to produce gas-gap, thereby leading to an increase in the cell voltage.

Therefore, prior to the installation of the membrane to the cell, it is at first wetted with water, brine or an aqueous alkali metal hydroxide liquor, then installed in a wet condition. In the installation of the membrane in a foregoing fashion, a mechanical securing is superior to welding, bonding or cementing, because the wetted membrane can not be welded and bonding of the wetted membrane, even when bonded, not only reduces bonding force, but also causes hydrolysis of adhesives. Furthermore, however tight the membrane may be installed, slack or wrinkles will occur during the course of operation over a long period of time. In such cases, when the membrane is installed by a mechanical means, slack and wrinkles can be easily removed by doing over again, thus operation being further continued without slack and wrinkles.

Next, description will be made by referring to FIG. 5 and FIG. 6 which show a state in which a glove-shaped finger fabricated by securing the sheet-like separator to the finger frame is assembled together with electrodes in the electrolytic cell.

In these fingers, electrodes (14) (for example, anodes) are mounted parallel on a bottom plate (13) and a wall plate (15) positioned in parallel with a row of the electrodes (14) is releasable.

FIG. 5 illustrates a state in which the wall plate (15) and the cell top cover (16) are removed from the cell, two directions being thereby opened, and the open ends are provided with flanges (17) and (18), respectively. From the side open end is the glove-shaped finger (19) introduced and the fingers (20) are interposed between the adjacent electrodes (14), (14)—. Between the frame plate (1) provided with the glove-shaped finger (19) and the flange (17) is a packing (21) inserted. Then, the wall plate (15) on which opposite polar electrodes (22) (for example, cathodes) are mounted is introduced so as to insert the electrodes (22), (22)—into the fingers (20), (20)—. On the inside of the wall plate (15) is a packing (23) located.

These parts assembled in the foregoing order are tightened firmly by the use of a securing means such as bolting in such a way that the packings (21), (23) and the frame plate (1) are interplaced between the flange (17) and the wall plate (15), further the cell top cover (16) is placed and secured on the flange (18) by insertion of a packing (28), thereby an electrolytic cell being fabricated.

The electrolytic cell so fabricated is separated into a first electrode compartment (24) (for example, cathode compartment) surrounded with the releasable wall plate (15) and the glove-shaped finger (19), and a second electrode compartment (for example, anode compartment) surrounded with the remaining cell walls, the cell top cover (16) and the glove-shaped finger (19). As is apparent from the foregoing description, the first electrode compartment (24) is provided with electrodes (22) (for example, cathodes) and the second electrode compartment (25) is provided with opposite polar electrodes (14) (for example, anodes). As a cathode a lath, a foraminous plate and the like are preferable which are made of SS, SUS and the like. As an anode, an anti-corrosive anode is preferred which is made of a platinum group metal, an alloy thereof or a metal lined with oxides thereof.

In cases, as shown in FIG. 6, where the bottom plate (13) on which the electrodes (14) are mounted is releasably secured using a packing (26) to a flange (27) located at the bottom of the cell (12), assembly or disassembly for exchange of electrodes (14) in the second compartment (25) is markedly facilitated.

In an embodiment as mentioned above, there is depicted that the glove-shaped finger (19) and the wall plate (15), on which electrodes (22) to be inserted into the fingers (20) are mounted, are inserted in the cell (12) from sideward, and the other electrodes (14) positioned parallel along the outside of fingers (20) are mounted on the bottom plate (13), but various modifications may be possible in a direction of inserting the glove-shaped finger (19), electrodes (22) and the other electrodes (14). That is, electrodes (14) may be mounted on a wall plate opposing the wall plate (15) or the cell top cover (16), and likewise the glove-shaped finger (19) and the electrodes (22) may also be inserted in the cell upward from the bottom or downward from the top, provided that both electrodes oppose each other maintaining their parallel relationship. There is also included in the present invention a modification that opposite wall plates of the cell (12) are allowed to be releasable respectively and the glove-shaped fingers are inserted face to face, thereby duplicating the capacity of the cell. Furthermore, it is also possible with ease by selecting a material in contact with a respective electrolyte to provide anodes in the first electrode compartment (24) and to provide cathodes in the second electrode compartment (25).

In the assemblage of the present electrolytic cell, it is preferred to position electrodes (14) in a slightly contracted form in their thickness so as not to damage the sheet-like separator (7), then to expand them during electrolysis to thus reduce anodes-cathodes spacing.

The present invention not only provides an advantage of decreasing cell voltage exerted by enlarging the thickness of electrodes (14) upon electrolysis to bring anodes to cathodes as closely as possible, more preferably to bring anodes and cathodes into contact with both surfaces of the separator, but also realizes enlargement of scale by increasing the length or the number of fingers (20), while adding no essential difficulties in installation of the separator and assembly of the cell.

Although not shown in the accompanying drawings, there are provided, needlessly, to the cell an inlet for water or a diluted aqueous caustic alkali solution, an inlet for brine, an outlet for the product liquor i.e., an aqueous alkali metal hydroxide liquor, outlets for gases generated, i.e., hydrogen gas and a halogen gas, respectively, and an outlet for depleted brine, as is the case with the conventional separator type electrolytic cell. Notwithstanding, when the cell is so constructed that the glove-shaped finger (19) is inserted upward from the bottom, a particular device has to be made as to the end portion of fingers with a view to removing gas generated in a first electrode compartment, which may disadvantageously lead to a complicated construction of the cell.

Hereinabove, embodiments of the present electrolytic cell were described with reference to the accompanying drawings, but to which embodiments the present invention is not limited and, of course, including a lot of modifications and applications without departure from the scope and the spirit of the present invention.

The present electrolytic cell is constructed such that a flat sheet of separator is immediately applied to form a glove-shaped finger without any peculiar processing including, such as, formation of a cylindrical or a glove shape by means of bonding or welding, so that a finger type electrolytic cell of a conventional diaphragm electrolytic cell type is produced with exceeding ease. Furthermore, as compared with a filter press type cell which is generally used when a sheet-like separator is employed, it is possible to supply a cell with a greater capacity per the same floor area. That is, a filter press type cell with a capacity of 150 KA at 20 A per $dm^2$ requires a floor area of 8 to 10 $m^2$, whereas the present electrolytic cell with the same capacity needs only 4 to 6 $m^2$ floor area. Moreover, the present electrolytic cell has numerous advantages that assembly or disassembly is by far easier than any other finger type electrolytic cell having ever been proposed before by the present inventors, and that more perfect sealing is provided to thus prevent leakage of electrolyte.

Furthermore the present electrolytic cell is suited to a construction of a mono-polar cell and it is also advantageous that it is possible to utilize the existing equipments effectively in conversion of a mercurial cell or a diaphragm cell to an ion exchange membrane cell.

As apparent from the foregoing, the present electrolytic cell has a lot of advantages over a filter press type cell. The present electrolytic cell has not so many joints and has a greater capacity per a unit installation area as well as a high efficiency per a unit volume of a cell. It further requires neither expensive materials for parts including cathodes and anodes nor strict mechanical tolerance, thereby resulting in a decrease in production cost. The assembly and disassembly are easy and simple, even if a sheet-like separator is employed, further, sealing is easy so that labor is drastically saved. It not only enables a contact construction, in which anodes and cathodes are in contact with the respective surfaces of the separator, to thus reduce the anodes-cathodes spacing to the minimal distance, through which cell voltage is lowered, maintains high current efficiency by keeping concentration of anodic and cathodic solutions uniform, but also realizes the scale-up of the equipment with a decreased cost in maintenance as well as operation.

What we claim is:

1. An electrolytic cell for the production of an aqueous alkali metal hydroxide liquor by the electrolysis of an aqueous alkali metal halide solution, wherein the cell is partitioned by a glove-shaped finger comprising two finger-shaped supports having fingers and extending parallel toward the inside of the cell from the opposite inner peripheries of a releasable plate secured to an inner wall of the cell by one releasable wall plate and a separator positioned adjacent to the fingers, said glove-shaped finger separating the cell into a first electrode compartment including said wall plate and a second electrode compartment including remainder walls of the cell, the first electrode compartment comprising at least one anode or cathode inserted in the glove-shaped finger and mounted on the releasable wall plate, and the second electrode compartment comprising opposite polar electrodes arranged along the outer surface of the separator of the glove-shaped finger.

2. The separator electrolytic cell of claim 1, wherein the one releasable wall plate is a side plate.

3. The separator electrolytic cell of claim 2, wherein the electrodes in the second electrode compartment are mounted on a bottom plate of the cell.

4. The separator electrolytic cell of claim 2, wherein the electrodes in the second electrode compartment are mounted on a side plate oppositing the side plate included in the first electrode compartment.

5. The separator electrolytic cell of claim 2, wherein the electrodes in the second electrode compartment are mounted on a cell top cover.

6. The separator electrolytic cell of claim 1, wherein the one releasable wall plate is the cell top cover.

7. The separator electrolytic cell of claim 6, wherein the electrodes in the second electrode compartment are mounted on the bottom plate of the cell.

8. The separator electrolytic cell of claim 6, wherein the electrodes in the second electrode compartment are mounted on a side plate of the cell.

9. The separator electrolytic cell of claim 1, wherein the one releasable wall plate is the bottom plate of the cell.

10. The separator electrolytic cell of claim 9, wherein the electrodes in the second electrode compartment are mounted on the cell top cover.

11. The separator electrolytic cell of claim 9, wherein the electrodes in the second electrode compartment are mounted on a side plate of the cell.

* * * * *